US011286684B2

(12) United States Patent
Mor

(10) Patent No.: US 11,286,684 B2
(45) Date of Patent: Mar. 29, 2022

(54) CONNECTION APPARATUS FOR MOUNTING A GUYED MAST

(71) Applicant: SA-RA ENERJIINSAAT TICARET VE SANAYI ANONIM SIRKETI, Ankara (TR)

(72) Inventor: Emre Mor, Ankara (TR)

( * ) Notice: Subject to any disclaimer, the term of this patent is extended or adjusted under 35 U.S.C. 154(b) by 0 days.

(21) Appl. No.: 16/757,211

(22) PCT Filed: Jun. 26, 2018

(86) PCT No.: PCT/TR2018/050324
§ 371 (c)(1),
(2) Date: Apr. 17, 2020

(87) PCT Pub. No.: WO2020/005173
PCT Pub. Date: Jan. 2, 2020

(65) Prior Publication Data
US 2021/0079683 A1 Mar. 18, 2021

(51) Int. Cl.
*E04H 12/22* (2006.01)
*E04H 12/20* (2006.01)
*E04H 12/10* (2006.01)

(52) U.S. Cl.
CPC ..... *E04H 12/2284* (2013.01); *E04H 12/20* (2013.01); *E04H 12/2261* (2013.01); *E04H 12/10* (2013.01)

(58) Field of Classification Search
CPC . E04H 12/2284; E04H 12/22; E04H 12/2261; E04H 12/2269; E04H 12/08; E04H 12/34
See application file for complete search history.

(56) References Cited

U.S. PATENT DOCUMENTS 1,796,720 A * 3/1931 Porter ..... E02D 27/42 52/299
4,043,133 A * 8/1977 Yegge ..... E02D 5/58 405/239

(Continued)

FOREIGN PATENT DOCUMENTS

CN 204311821 U 5/2015
CN 105442906 A 3/2016
CN 106939614 B 7/2017

OTHER PUBLICATIONS

International Search Report for Corresponding PCT/TR2018/050324.
Written Opinion of the ISA for Corresponding PCT/TR2018/050324.

*Primary Examiner* — Gisele D Ford
(74) *Attorney, Agent, or Firm* — Egbert, McDaniel & Swartz, PLLC

(57) ABSTRACT

Disclosed is a connection apparatus and foundation connection method developed in order to be used in guyed overhead line towers. The foundation connection method and connection apparatus mentioned above enables all the legs of a tower to be fixed onto a single base plate. According to the structure of foundation connection apparatus, the angle determining tubes welded to the base plate are capped with a welded treated cap plate which is connected to the bottom cone plate located at the ends of the legs of the towers by a pin. To provide angular rotation between the connection apparatus and the leg, the beveled plate is squeezed between the treated cap plate and the bottom cone plate.

8 Claims, 2 Drawing Sheets

(56) References Cited

U.S. PATENT DOCUMENTS 4,677,444 A * 6/1987 Perek ..... E04H 12/34 343/882
5,063,719 A * 11/1991 Matsuo ..... E04H 12/2261 52/296
5,233,809 A * 8/1993 Gropper ..... E04H 12/187 343/882
6,085,432 A * 7/2000 Van der Sluis ..... E04G 21/185 269/904
8,347,514 B1 * 1/2013 McCollum ..... E02D 27/42 33/1 G
2005/0285011 A1 * 12/2005 Harwood ..... E04H 12/2261 248/519
2008/0184633 A1 * 8/2008 Hamilton ..... E04H 12/2261 52/127.12
2009/0314910 A1 * 12/2009 Jeanveau ..... E04H 12/2269 248/231.71
2010/0229415 A1 * 9/2010 Knudsen ..... E04H 12/2284 33/613
2011/0142682 A1 * 6/2011 Gevers ..... E04H 12/08 416/244 R
2012/0263544 A1 * 10/2012 Oestergaard ..... E02B 17/0004 405/224
2013/0048825 A1 * 2/2013 Stalemark ..... B23B 47/28 248/534
2014/0015255 A1 * 1/2014 Schellstede ..... E02D 27/425 290/55
2014/0345218 A1 * 11/2014 Larsen ..... E02B 17/0004 52/299
2015/0082720 A1 * 3/2015 Rodriguez ..... E04H 12/22 52/298
2016/0097199 A1 * 4/2016 Saiidi ..... E04C 3/36 52/126.7
2016/0208453 A1 * 7/2016 Larsen ..... E02B 17/02
2017/0022679 A1 * 1/2017 Hayman ..... E02D 27/42
2017/0030045 A1 * 2/2017 Krause ..... E02D 27/425
2017/0101750 A1 * 4/2017 Connell ..... E01F 9/685
2017/0114562 A1 * 4/2017 Oesch ..... E04H 12/08
2017/0122490 A1 * 5/2017 Verstrate ..... H01Q 1/1242
2017/0143149 A1 * 5/2017 Finnin, Jr. ..... E04H 12/2238
2017/0152641 A1 * 6/2017 Serna Garc A-Conde ..... F03D 13/22
2017/0152672 A1 * 6/2017 Santucci ..... E04H 12/182
2017/0180612 A1 * 6/2017 Marashdeh ..... H04N 5/23203
2017/0183888 A1 * 6/2017 Abe ..... E04H 12/182
2017/0184076 A1 * 6/2017 Horn ..... E04H 12/2284
2017/0189736 A1 * 7/2017 Martin ..... A63B 21/4029
2017/0191239 A1 * 7/2017 Kim ..... E02D 27/42
2017/0211289 A1 * 7/2017 Lee ..... E04H 12/2238
2017/0244234 A1 * 8/2017 Behr ..... E04H 12/2238
2017/0279259 A1 * 9/2017 Ma ..... H02G 7/20
2018/0223497 A1 * 8/2018 Zhu ..... E02D 5/60
2018/0251996 A1 * 9/2018 Roy ..... E02D 27/42
2018/0283032 A1 * 10/2018 Harmer ..... E04H 12/10
2018/0355851 A1 * 12/2018 Brohm ..... E04H 12/34
2021/0111664 A1 * 4/2021 Zuritis ..... E04H 6/025

* cited by examiner

CONNECTION APPARATUS FOR MOUNTING A GUYED MAST

TECHNICAL FIELD

The invention is related to a tower-foundation connection apparatus and a connection method that can be used during tower erection of guyed towers in the electricity transmission line industry.

PRIOR ART

Nowadays as a result of the increase in electricity requirement, production is being carried out in places where energy sources are located (water, coal, wind, natural gas etc.) but these energy sources are far from the places of energy consumption. Thereby the process of transferring electricity to cities and industries has gained importance. Overhead lines (OHL) are used in order to transfer high voltage electricity to consumption centers from the production facilities. The main role of towers that are usually placed at appropriate intervals and height along the line is to hold the wires of electricity distribution lines at a certain distance above from the ground and from each other. OHL towers are classified according to the material they are produced from and according to their functions in the line.

Nowadays towers made of steel are frequently preferred and they can be used in all kinds of voltage stages. The base or foundations of the steel towers must be filled with concrete only, and gravel, soil or sand must not be used. Steel towers have a longer usage life and are lighter in comparison to concrete towers. Steel towers can be applied to all kinds of arrangements of conductors. It is also easier to repair the tower break downs that may occur due to any reason.

Guyed towers are towers that are fixed by means of several tension cables. The foundations of the guyed towers are generally different from conventional foundations. Since foundation needs to be connected to the base with a 90° angle, sometimes the surface needs to be angular; therefore, this kind of foundation is difficult to obtain as it is difficult to pour the concrete and mount the mould. When that mounting difficulty is combined with land conditions, important problems may arise as a result of faulty placement of the pre-produced foundation or if the foundation is not poured perfectly at a correct angle. Moreover, as the weight of the guyed towers can reach up to 15-20 tons, and as entirely assembled towers are lifted in one piece and mounted with suspensions onto the foundation, even a small error may damage the foundation or connection parts as a result of impact. In such cases, the repair procedures of the foundation and the connection parts lead to great expenses and loss of time. Preparation on the mould of base for guyed towers is a costly process that necessitates expertise and precise calculation. For each possible size and angle of the tower leg it is necessary to create foundation from scratch Several studies have been carried out in order to provide easier mounting and reinforcing foundation connections of guyed towers. One of these studies is the invention subject to the patent numbered CN106939614. The invention is related to a highly reliable guyed tower base. The guyed tower foundation comprises a base body, a tower body, a first support mechanism and a second support mechanism. The first support mechanism comprises a main body and several rolling units that have been arranged at equal distances from each other on the main body. Each rolling unit comprises a limitation block, a spring, a grip ring and a sphere. The second support mechanism comprises a support block and reinforcement angled steel on the support block. A support column has been arranged on the base body of the base of the guyed tower with high reliability, and the base body has been filled with concrete; due to this reason, the base body has a very high load carrying capacity, and a hook has been arranged on the base of the base body and as a result it has been prevented for the base body to be lifted upwards by means of an upward force. The second support mechanism has been replaced with a conventional latch connection according to the hinged connection of the base body and the tower body and rolled connection having lower friction forces have been adopted in order to prevent the abrasion of connection part of the tower body and the foundation body. Additionally, by means of the design of the sliding mechanism, the support block can be better connected to the sliding mechanism. Finally, a tension spring that has been arranged between the base body and the support block has been used to prevent the separation of the base body and the support block from each other.

Another study is the invention subject to the patent numbered CN105442906. The invention described a tower anchor structure comprising the main column and a foundation of the guyed tower. The main column and foundation are connected to each other by means of first and second connection parts respectively; the first connection part is a flat plate and the second connection plate is support plate having an arc surface or the first connection part is a support plate shaped like an arc, and the second connection plate is a flat plate; therefore, a point hinge structure forms a plane and an arc surface when they contact each other. For a connection with the arc-surface support plate a fixed plate can be arranged and in order to limit the first and second connection parts base round steel can be arranged. Base round steels comprise nuts and anti-loosening structures at the ends thereof. The danger caused by the temporary wind load can be efficiently prevented and advantages are provided during the processing, mounting and construction of foundation processes.

Another study is the invention subject to the utility model numbered CN204311821. The utility model describes a guyed main tower, and a foundation adjustment part. The guyed tower main leg and the foundation adjustment part comprise a base part, a frame and a connection plate. The base part is fixedly connected to the foundation. The connection plate mentioned, is fixedly coupled with the main leg of the tower, and the relative vertical rotation of the connection plate, is obtained by means of the relative horizontal rotation of the connection plate by turning the support axle horizontally. The support axle is provided by rotating the mechanism. The force subjected to the guyed tower is submitted and maintained by the frame. In order to avoid for the weld on the pan shaped base to have a significant ratio and in order to avoid loss of time during a processing cycle, the usage of a pan shaped base has been abstained. The dosage of concrete and steel has been reduced. The main leg and the base connection have been made safer and more reliable without affecting the contact thereof.

As a result, due to the presence of disadvantages of the prior art and the insufficiency of the solutions to overcome these disadvantages, a necessity to provide developments in the related art has occurred.

BRIEF DESCRIPTION OF THE INVENTION

The present invention is related to a connection apparatus and a foundation connection method developed to be used in the mounting of guyed overhead line tower that meets all of the above-mentioned requirements and eliminates all of the disadvantages and brings about certain additional advantages.

Based on the known prior art, the aim of the invention is to provide fast and easy connection to the foundation via chemical anchors, mechanical drop in anchors, previously mounted cast in place anchors or by means of welding to a steel cap.

The aim of the invention is to ensure a significant reduction in error ratio when adapting the apparatus used for connection to the present foundation by providing a level balancing option with anchorage nuts during the mounting of the aforementioned apparatus.

Another aim of the invention is to ensure that the apparatus can be repaired and changed easily without damaging the base by means of the structure of the connection apparatus used in the base connection method, when aforementioned apparatus breaks down.

Another aim of the invention is to provide mounting and a transportation advantage as the apparatus used in connection and the base connection method is light in weight.

Another aim of the invention is to reduce costs by means of the design of the apparatus used in connection and the base connection method.

Another aim of the invention is to ensure that the tower and foundation calculations are simpler in comparison to the prior art, due to the design of the apparatus used in connection and the base connection method.

Another aim of the invention is to ensure that the foundation can be formed in a single type that is applied for all towers as tubes for each different angle and length of the legs don't have to be cut in different angles and apparatus for various connection angles can be produced in a single shape/type by means of the fast and easy production of the apparatus used in connection and the foundation connection method.

The structural and characteristic features of the invention and all of its advantages shall be understood more clearly by means of the attached figures and the detailed description written by making references to these figures, therefore the evaluation of the invention has to be carried out by taking into consideration these figures and the detailed description.

BRIEF DESCRIPTION OF THE FIGURES

The embodiment of the present invention and additional components must be evaluated together with the figures described below, to further understand the advantages of the invention.

REFERENCE NUMBERS

Figure 1:
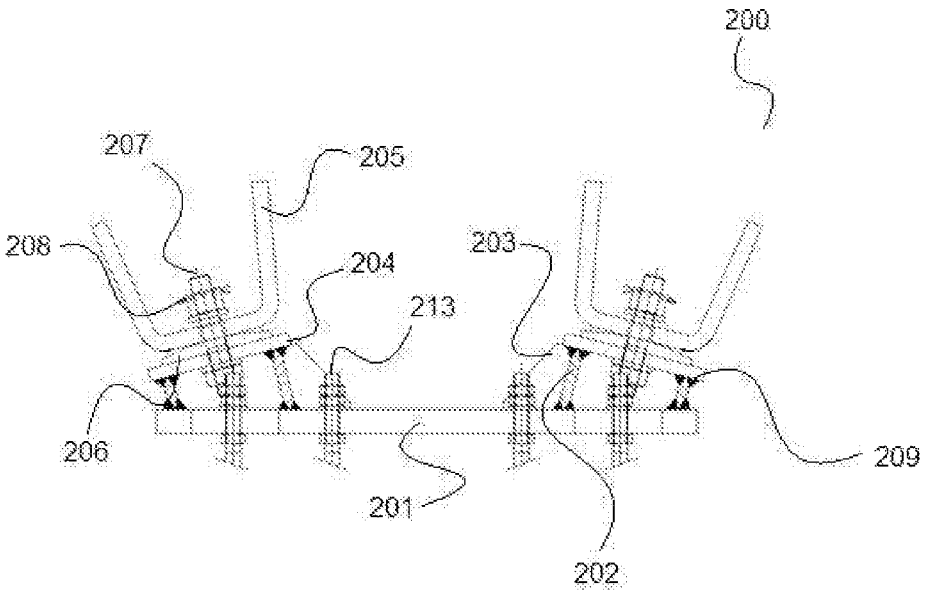
FIG. 1; is the front schematic view of the connection apparatus.

100. Overhead line tower
101. Leg
200. Connection apparatus
201. Base plate
202. Angle determining tube
203. Stiffener plate
204. Treated cap plate
205. Bottom cone plate
206. Beveled plate
207. Pin
208. Nut
209. Welded connection
210. Drainage hole
211. Anchorage holes
212. Central dimple
213. Anchorage rods and leveling nut system

DETAILED DESCRIPTION OF THE INVENTION

In this detailed description the connection apparatus (200) and foundation connection method during the mounting of a tower (100) that has been developed in order to be used in guyed overhead line tower (100) subject to the invention has been described only for illustration purposes to further explain the invention and without any intention of limitation of the invention.

The connection apparatus (200) shown in FIG. 1, comprises at the lowermost section, a base plate (201) which has an anchorage hole (211) and a drainage hole (210) thereon, onto which all of the components are connected to. The connection to base plate (201) mentioned above is preferably carried out by means of welding. On the mentioned base plate (201) an angle determining tube (202) is provided which is connected by means of a weld connection (209) and onto which a leg (101) has been engaged for easy and safe connection. Angle determining tube (202) that has a certain calculated average angle that does not vary depending on the leg angle that may change depending on the shape and height of the tower (100), has treated cap plate (204) on top to which the tower leg (101) is connected. In order to increase rigidity of above-mentioned base plate (201) and to provide a strong connection between the angle determining tube (202) and the base plate (201) a stiffener plate (203) has been positioned. The bottom cone plate (205) onto which the leaf springs are engaged to at the end of the leg (101) is made of a hot rolled plate. The beveled plate (206) placed between the treated cap plate (204) and the bottom cone plate (205), has a semi spherical shape and it allows an angular rotation movement when the bottom cone plate (205) is being safely and strongly engaged to the treated cap plate (204). In the mid section of the mentioned bottom cone plate (205) a pin (207) has been positioned such that it allows the rotation and inclination of the leg (101) when necessary but prevents the linear movement of the bottom cone plate (205) to the treated cap plate (204). Nut (208) and pin (207) have a cavity inside for mounting Split/Cotter Pin to keep them in place.

Figure 2:
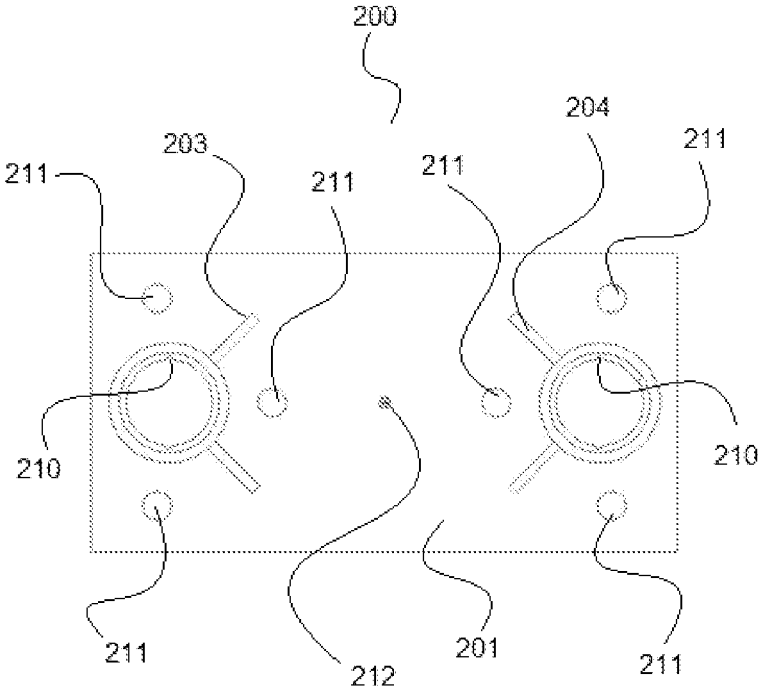
FIG. 2; is the general top schematic view of the connection apparatus.

The drainage hole (210) that has been formed on the base plate (201) of the connection apparatus (200) shown in FIG. 2, allows excess zinc mixture to be released during hot dipping galvanization process. The anchorage holes (211) that have been formed on the base plate (201) enable the engagement of the anchorage rods and leveling nut system (213). Central dimple (212) positioned at the mid section of the base plate (201) enables to determine the center of the base plate (201) in order to measure adjustment alignment for base plate (201) to be fixed at its position, the apparatus comprises anchorage rods and leveling nut system (213) comprising a leveling nut in order position the plate at a desired position.

Figure 3A:
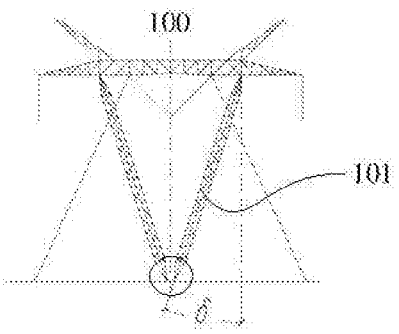
FIG. 3*a*; is the general schematic view of the minimum tower height leg angle configuration, FIG. 3*b*; is the general schematic view of the maximum tower height leg angle configuration, FIG. 3*c*; is the schematic display of connection apparatus location on tower and detailed view of tower legs mounted to the connection apparatus, FIG. 4*a*; is the schematic display of the angle of the lower conical plate at the minimum tower height.
Figure 3B:
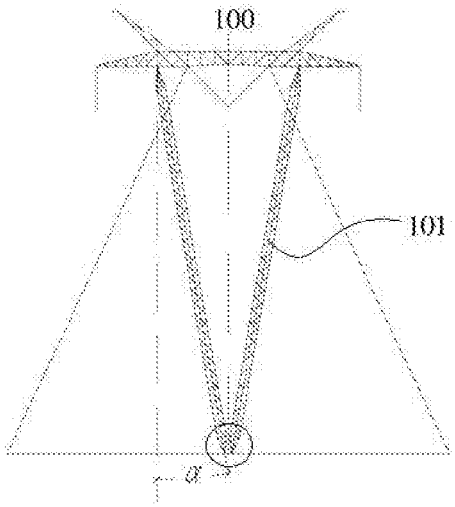
Figure 3C:
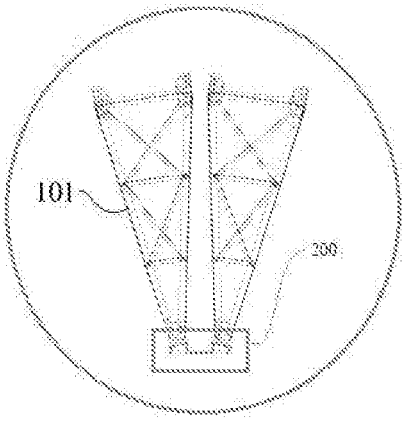
Figure 4A:
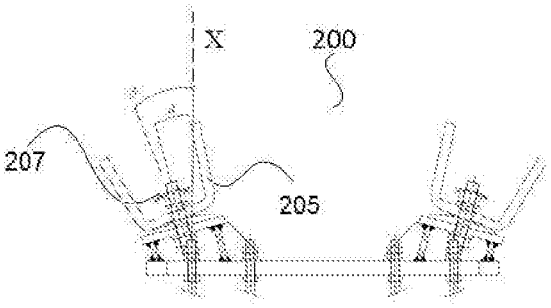
FIG. 4*b*; is the schematic display of the angle of the lower conical plate at the maximum tower height.
Figure 4B:
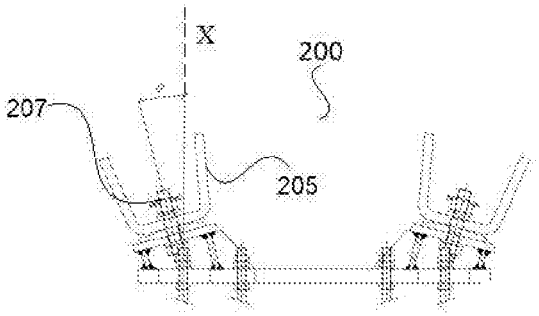

The angle determining tubes (202) that are positioned angularly are welded onto the base plate (201) in order to fix both legs (101) of the tower (100) shown in FIG. 3, to a single base plate (201) and a treated cap plate (204) is welded to the opening section of the angle determining tubes (202). The bottom cone plate (205) at the ends of the legs (101) of the towers (100) are sealed by placing a beveled plate (206) there-between, via pin (207). As the surface of beveled plate (206) is circular, the leg at the top section (101) operates such that it is connected with a rotating support. As the forces received from the legs (101) are different and differ continuously according to load, large stiffener plate (203) have been welded to the base plate (201) and angle determining tubes (202) in order to balance the load distribution and to prevent deformation due to the difference of tension formed on the left and right side of the base plate (201). Moreover, as the connections are designed as rotating supports, special joiner nut (208) has been used during the mounting of the pin (207). The angle of the angle determining tubes (202) provided in the connection apparatus (200) shown in FIG. 3*a* and FIG. 3*b*, varies depending on the height of the utility tower (100), in other words depending on the leg length (101). In FIG. 3*a* the angle between the tower leg (101) and the vertical (X) is shown by δ for the minimum tower (100) height, while in FIG. 3*b* the angle between the tower leg (101) and the vertical (X) is shown by a for the maximum tower (100) height. As it is shown in the FIG. 4*a*, the angle δ—the angle between the bottom cone plate (205) axis and the vertical (X), corresponding to minimum tower (100) height is greater in magnitude than the angle α—the angle between the bottom cone plate (205) axis and the vertical (X), corresponding to maximum tower (100) height that is shown in FIG. 4*b*.

The base plate (201) dimensions of connection apparatus (200) may vary according to the angle determining tubes (202) angle, length, anchorage hole (211) placement and number of holes and tower type. The foundation connection method during the mounting of above mentioned tower (100), has been developed to connect legs (101) of the tower (100) to a single connection apparatus (200) and it has been developed to ensure that the concrete foundation design application and the tower (100) is suitable with each other.

The invention claimed is:

1. A connection apparatus for mounting a guyed overhead line tower, the guyed overhead line tower having a plurality of legs, the connection apparatus comprising:

a base plate having anchorage holes therein;

an angle determining tube attached to said base plate, said angle determining tube having a treated cap plate attached to a top of said angle determining tube, the treated cap plate holding a beveled plate, the beveled plate adapted to transfer forces from one of the plurality of legs of the guyed overhead line tower to said angle determining tube and to said base plate; and a bottom cone plate, the beveled plate being positioned between the treated cap plate and said bottom cone plate so as to allow rotation via angular movement between the one leg and the connection apparatus when the treated cap plate is engaged with said bottom cone plate.

2. The connection apparatus of claim 1, further comprising:

a pin positioned at a mid-section of said bottom cone plate so as to limit linear movement of said bottom cone plate relative to the treated cap plate.

3. The connection apparatus of claim 2, further comprising a nut affixed to said pin.

4. A foundation connection method for mounting a guyed overhead line tower, the guyed overhead line tower having a plurality of legs, the foundation connection method comprising:

engaging angle determining tubes that are angularly positioned on a single base plate so as to fix the plurality of legs of the guyed overhead line tower onto the single base plate;

engaging treated cap plates to an opening section of the angle determining tubes; and sealing bottom cone plates respectively at ends of the plurality of legs of the guyed overhead line tower via a pin by placing a beveled plate therebetween.

5. The foundation connection method of claim 4, further comprising:

welding the angle determining tubes to the single base plate.

6. The foundation connection method of claim 4, further comprising:

welding a treated cap plate to the opening section of the angle determining tubes.

7. The foundation connection method of claim 4, further comprising:

welding stiffener plates to the angle determining tubes and to the single base plate.

8. The foundation connection method of claim 4, further comprising:

applying a nut to the pin during the step of sealing.

* * * * *